US006773073B1

(12) United States Patent
Escobedo

(10) Patent No.: US 6,773,073 B1
(45) Date of Patent: Aug. 10, 2004

(54) ADJUSTABLE FOOT REST

(76) Inventor: Liborio Escobedo, 10407 Sagerock, Houston, TX (US) 77089

( * ) Notice: Subject to any disclaimer, the term of this patent is extended or adjusted under 35 U.S.C. 154(b) by 0 days.

(21) Appl. No.: 10/320,569

(22) Filed: Dec. 13, 2002

(51) Int. Cl.[7] ..... A47C 20/00

(52) U.S. Cl. ..... 297/423.34; 297/423.3; 297/423.37; 297/423.26; 280/304.1

(58) Field of Search ..... 297/423.33, 423.34, 297/423.3, 423.37, 423.26; 403/91, 97; 280/304.1

(56) References Cited

U.S. PATENT DOCUMENTS 1,324,895 A * 12/1919 Hertz et al. ..... 403/97
2,236,983 A * 4/1941 Yusek ..... 297/423.35
2,740,465 A * 4/1956 Mugler ..... 297/31
4,033,624 A * 7/1977 Jun ..... 297/423.3
4,917,343 A * 4/1990 Wainscott ..... 248/447.2
5,033,793 A 7/1991 Quintile
5,259,664 A 11/1993 Cottle
5,398,978 A * 3/1995 Gagnon ..... 285/184
5,522,644 A * 6/1996 Peek ..... 297/423.26
5,711,580 A 1/1998 Barclay et al.
6,086,284 A * 7/2000 Callahan ..... 403/93
6,217,050 B1 * 4/2001 Dickie et al. ..... 280/291
6,352,307 B1 * 3/2002 Engman ..... 297/284.11
6,499,756 B2 * 12/2002 Amirola ..... 280/304.1
6,503,018 B2 * 1/2003 Hou et al. ..... 403/97
6,543,854 B1 * 4/2003 Finch ..... 297/423.37
6,575,492 B2 * 6/2003 Davidson ..... 280/647

* cited by examiner

*Primary Examiner*—Peter M. Cuomo
*Assistant Examiner*—Stephanie Harris

(57) ABSTRACT

A adjustable foot rest for being used with a wheelchair to allow the foot of the user to positioned at a comfortable angle. The adjustable foot rest includes an adjustment assembly being designed for being coupled to hanger bracket of the wheel chair. A rest member is pivotally coupled to the adjustment assembly. The rest member is designed for supporting the foot of the user when the user is sitting in the wheelchair. The adjustment member permits the rest member to be angled with respect to the wheelchair whereby the adjustment member is designed for allowing the user to position an angle of the rest member at a comfortable angle to support the foot of the user.

8 Claims, 3 Drawing Sheets

ADJUSTABLE FOOT REST

BACKGROUND OF THE INVENTION

1. Field of the Invention

The present invention relates to elevating footrests and more particularly pertains to a new adjustable foot rest for being used with a wheelchair to allow the foot of the user to positioned at a comfortable angle.

2. Description of the Prior Art

The use of elevating footrests is known in the prior art. U.S. Pat. No. 5,711,580 describes a system for extending and elevating the footrest of a wheel chair. Another type of elevating footrest is U.S. Pat. No. 5,259,664 having an assembly for extending and retracting the footrest of a wheelchair. U.S. Pat. No. 5,033,793 has a strut that is extendable to allow for the extension of a footrest away from a wheel chair.

While these devices fulfill their respective, particular objectives and requirements, the need remains for a device that has certain improved features that allow the footrest to be angled with respect to the wheelchairs to provide a more comfortable position for the foot of the user.

SUMMARY OF THE INVENTION

The present invention meets the needs presented above by providing a pair of adjustment members selectively pivotal with respect to each other to allow the footrest to angled with respect to the wheelchair.

Still yet another object of the present invention is to provide a new adjustable foot rest that maintains a comfort level of a user who is positioned in the wheelchair.

To this end, the present invention generally comprises an adjustment assembly being designed for being coupled to hanger bracket of the wheel chair. A rest member is pivotally coupled to the adjustment assembly. The rest member is designed for supporting the foot of the user when the user is sitting in the wheelchair. The adjustment member permits the rest member to be angled with respect to the wheelchair whereby the adjustment member is designed for allowing the user to position an angle of the rest member at a comfortable angle to support the foot of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
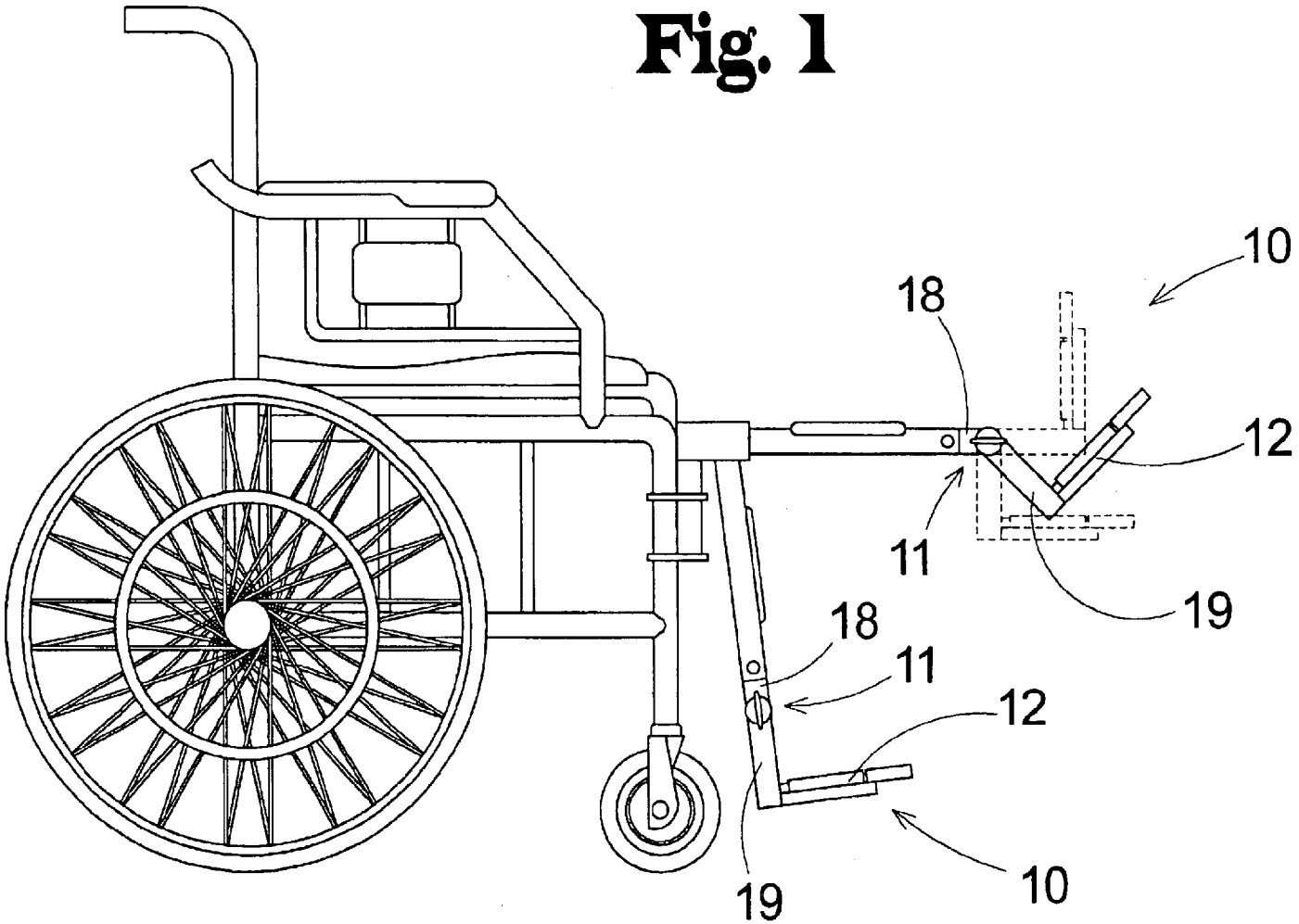
FIG. 1 is a side view of a new adjustable foot rest according to the present invention shown in use on a wheel chair.
Figure 2:
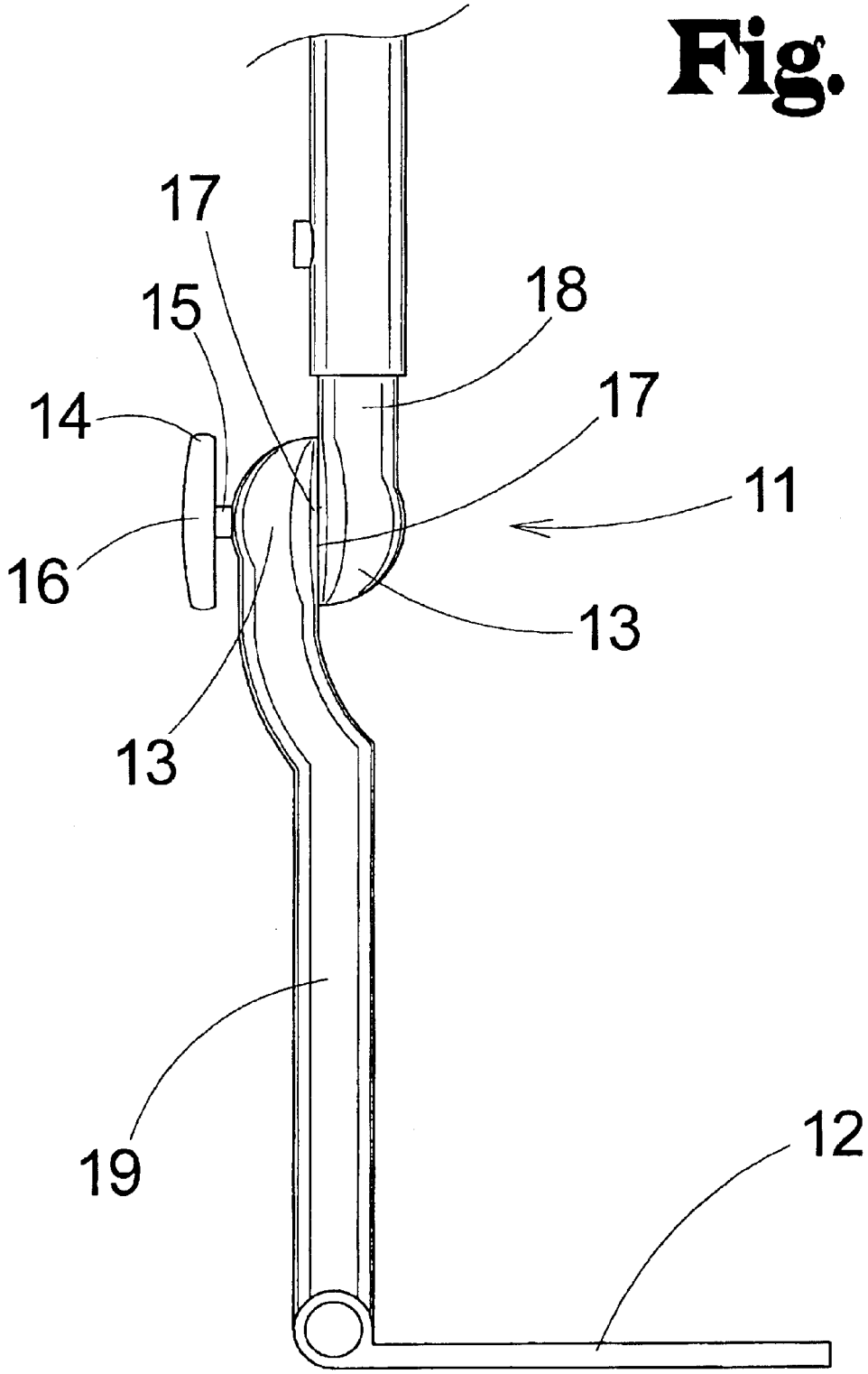
FIG. 2 is a top view of the present invention.
Figure 3:
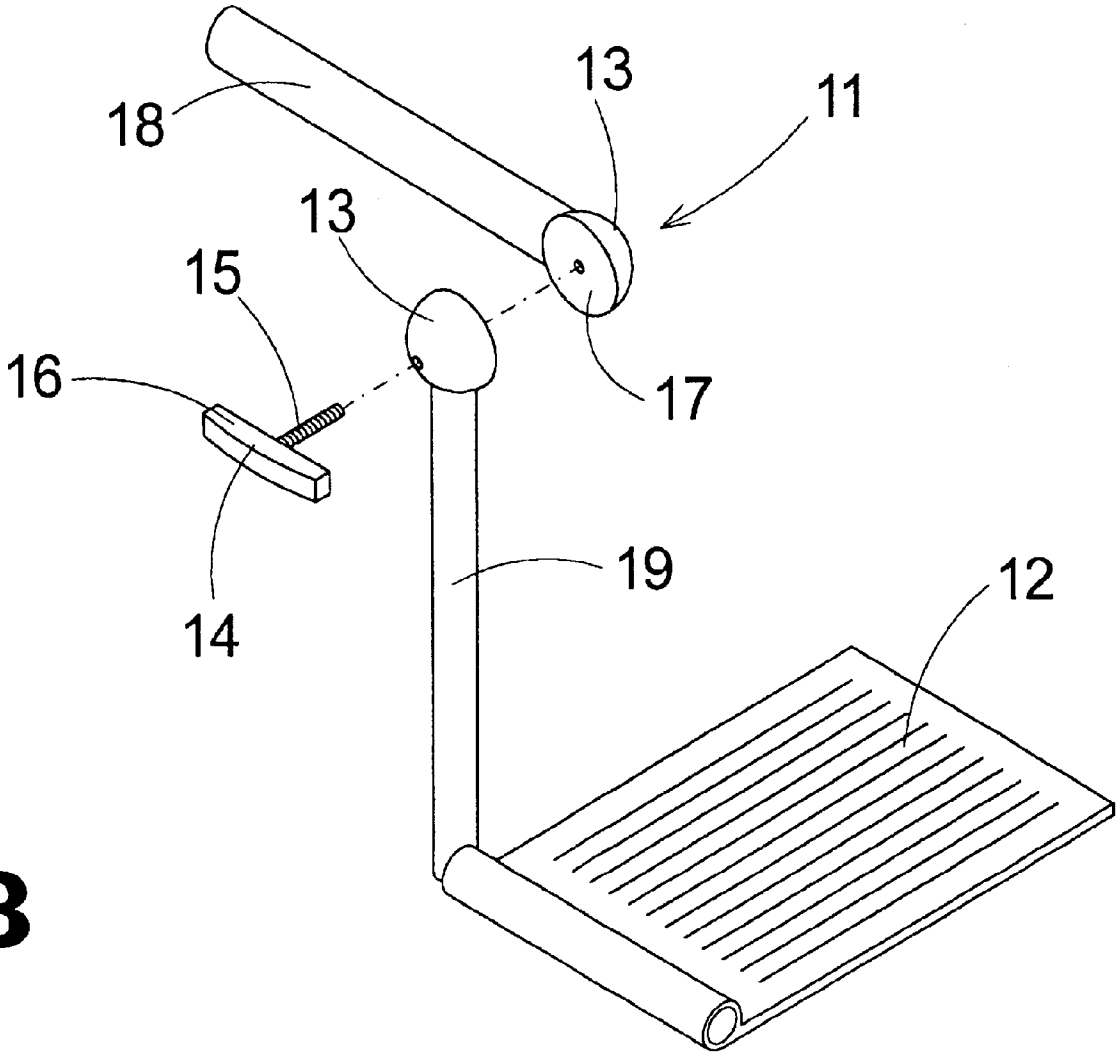
FIG. 3 is a perspective exploded view of the present invention.

With reference now to the drawings, and in particular to FIGS. 1 through 3 thereof, a new adjustable foot rest embodying the principles and concepts of the present invention and generally designated by the reference numeral 10 will be described.

As best illustrated in FIGS. 1 through 3, the adjustable foot rest 10 generally comprises an adjustment assembly 11 being designed for being coupled to hanger bracket of the wheel chair.

A rest member 12 is pivotally coupled to the adjustment assembly 11. The rest member 12 is designed for supporting the foot of the user when the user is sitting in the wheelchair. The adjustment member permits the rest member 12 to be angled with respect to the wheelchair whereby the adjustment member is designed for allowing the user to position an angle of the rest member 12 at a comfortable angle to support the foot of the user.

The adjustment assembly 11 comprises a pair of adjustment members 13. One of the adjustment members 13 is coupled to the rest member 12 whereby the other one of the adjustment members 13 is designed for being coupled to the hanger bracket of the wheelchair. One of the adjustment members 13 is pivotal with respect to the other one of the adjustment members 13 whereby the angle of the rest member 12 with respect to the wheel chair is adjustable.

The adjustment assembly 11 comprises a fastening member 14. The fastening member 14 selectively engages each of the adjustment members 13. The fastening member 14 selectively abuts one of the adjustment members 13 against the other one of the adjustment members 13 to maintain the rest member 12 at a desired angle with respect to the wheelchair when the fastening member 14 is actuated by the user. The fastening member 14 permits one of the adjustment members 13 to pivot with respect to the other one of the adjustment members 13 to allow the angle of the rest member 12 to be adjusted when the fastening member 14 is actuated by the user.

The fastening member 14 of the adjustment assembly 11 comprises a rod portion 15. The rod portion 15 threadably extends through each of the adjustment members 13. The rod portion 15 is rotatable in a first direction for bringing the adjustment members 13 together to inhibit rotation of one of the adjustment members 13 with respect to the other one of the adjustment members 13. The rod portion 15 is rotatable in a second direction for separating the adjustment members 13 to allow one of the adjustment members 13 to be pivoted with respect to the other one of the adjustment members 13.

The fastening member 14 comprises a handle portion 16. The handle portion 16 is coupled to the rod portion 15 of the fastening member 14 opposite the adjustment members 13. The handle portion 16 is designed for being engaged by a hand of the user for facilitating rotation of the rod member with respect to the adjustment members 13.

Each of the adjustment members 13 comprises an engaging face 17. The engaging face 17 of one of the adjustment members 13 selectively abuts the engaging face 17 of the other one of the adjustment members 13 for frictionally coupling the adjustment members 13 together for maintaining the rest member 12 at the desired angle.

The adjustment assembly 11 comprises a mounting member 18. The mounting member 18 is coupled to one of the adjustment members 13. The mounting member 18 is designed for being selectively coupled to the hanger bracket of the wheel chair whereby the mounting member 18 selectively couples the associated one of the adjustment members 13 to the hanger bracket of the wheel chair.

The adjustment assembly 11 comprises an extension member 19. The extension member 19 is coupled to one of the adjustment members 13. The rest member 12 is pivotally coupled to the extension member 19 opposite the associated one of the adjustment members 13. The extension member 19 is for positioning the rest member 12 away from the adjustment members 13 of the adjustment assembly 11.

In use, the user couples the mounting member 18 to the hanger bracket of the wheelchair. The handle portion 16 of the fastening member 14 is then actuated by the user to rotate the rod portion 15 of the fastening member 14 to allow the adjustment members 13 to separate. The extension portion and the rest member 12 are then pivoted with respect to the wheelchair to a desired angle to allow the angle of the rest member 12 to be positioned for comfort for the user in the wheelchair. The handle portion 16 of the fastener member is the actuated again to rotate the rod portion 15 in a second direction press the engaging face 17 of each of the adjustment members 13 against each other to secure the rest member 12 at the desired angle. A pair of adjustable footrests may be used with wheelchair with each of said adjustable foot rests being coupled to one of the hanger brackets to allow for positioning of both feet of the user in comfortable positions when the user is sitting in the wheelchair.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable footrest for allowing a user to adjust the positioning of their feet to be more comfortable when sitting in a wheelchair, the adjustable footrest comprising:

an adjustment assembly being adapted for being coupled to a hanger bracket of the wheel chair;

a rest member being pivotally coupled to said adjustment assembly, said rest member being adapted for supporting the foot of the user when the user is sitting in the wheelchair, said adjustment member permitting said rest member to be angled with respect to the wheelchair such that said adjustment member is adapted for allowing the user to position an angle of said rest member at a comfortable angle to support the foot of the user;

said adjustment assembly comprising a pair of adjustment members, one of said adjustment members being coupled to said rest member such that the other one of said adjustment members is adapted for being coupled to the hanger bracket of the wheelchair, one of said adjustment members being pivotal with respect to the other one of said adjustment members such that the angle of said rest member with respect to the wheel chair is adjustable; and each of said adjustment members comprising a domed exterior face, said domed exterior face of one of said adjustment members being positioned opposite said domed exterior face of said other of said adjustment members when one of said adjustment members abuts the other one of said adjustment members, said domed face of each of said adjustment members being adapted for deflecting garments of the user away from said adjustment members to inhibit the garments from becoming caught between said adjustment members.

2. The adjustable footrest as set forth in claim 1, further comprising:

said adjustment assembly comprising a fastening member, said fastening member selectively engaging each of said adjustment members, said fastening member selectively abutting one of said adjustment members against the other one of said adjustment members to maintain said rest member at a desired angle with respect to the wheelchair when the fastening member is actuated by the user, said fastening member permitting one of said adjustment members to pivot with respect to the other one of said adjustment members to allow the angle of said rest member to be adjusted when the fastening member is actuated by the user.

3. The adjustable footrest as set forth in claim 2, further comprising:

said fastening member of said adjustment assembly comprising a rod portion, said rod portion threadably extending through each of said adjustment members, said rod portion being rotatable in a first direction for bringing said adjustment members together to inhibit rotation of one of said adjustment members with respect to the other one of said adjustment members, said rod portion being rotatable in a second direction for separating said adjustment members to allow one of said adjustment members to be pivoted with respect to the other one of said adjustment members.

4. The adjustable footrest as set forth in claim 3, further comprising:

said fastening member comprising a handle portion, said handle portion being coupled to said rod portion of said fastening member opposite said adjustment members, said handle portion being adapted for being engaged by a hand of the user for facilitating rotation of said rod member with respect to said adjustment members.

5. The adjustable footrest as set forth in claim 1, further comprising:

each of said adjustment members comprising an engaging face, said engaging face of one of said adjustment members selectively abutting said engaging face of the other one of said adjustment members for frictionally coupling said adjustment members together for maintaining said rest member at the desired angle.

6. The adjustable footrest as set forth in claim 1, further comprising:

said adjustment assembly comprising a mounting member, said mounting member being coupled to one of said adjustment members, said mounting member being adapted for being selectively coupled to the hanger bracket of the wheel chair such that said mounting member selectively couples the associated one of said adjustment members to the hanger bracket of the wheel chair.

7. The adjustable footrest as set forth in claim 1, further comprising:

said adjustment assembly comprising an extension member, said extension member being coupled to one of said adjustment members, said rest member being pivotally coupled to said extension member opposite the associated one of said adjustment members, said extension member being for positioning said rest member away from said adjustment members of said adjustment assembly.

8. An adjustable footrest fox allowing a user to adjust the positioning of their feet to be more comfortable when sitting in a wheelchair, the adjustable footrest comprising:

an adjustment assembly being adapted for being coupled to a hanger bracket of the wheel chair;

a rest member being pivotally coupled to said adjustment assembly, said rest member being adapted for supporting the foot of the user when the user is sitting in the wheelchair, said adjustment member permitting said rest member to be angled with respect to the wheelchair such that said adjustment member is adapted for allowing the user to position an angle of said rest member at a comfortable angle to support the foot of the user;

said adjustment assembly comprising a pair of adjustment members, one of said adjustment members being coupled to said rest member such that the other one of said adjustment members is adapted for being coupled to the hanger bracket of the wheelchair, one of said adjustment members being pivotal with respect to the other one of said adjustment members such that the angle of said rest member with respect to the wheel chair is adjustable;

each of said adjustment members comprising a domed exterior face, said domed exterior face of one of said adjustment members being positioned opposite said domed exterior face of said other of said adjustment members when one of said adjustment members abuts the other one of said adjustment members, said domed face of each of said adjustment members being adapted for deflecting garments of the user away from said adjustment members to inhibit the garments from becoming caught between said adjustment members;

said adjustment assembly comprising a fastening member, said fastening member selectively engaging each of said adjustment members, said fastening member selectively abutting one of said adjustment members against the other one of said adjustment members to maintain said rest member at a desired angle with respect to the wheelchair when the fastening member is actuated by the user, said fastening member permitting one of said adjustment members to pivot with respect to the other one of said adjustment members to allow the angle of said rest member to be adjusted when the fastening member is actuated by the user;

said fastening member of said adjustment assembly comprising a rod portion, said rod portion threadably extending through each of said adjustment members, said rod portion being rotatable in a first direction for bringing said adjustment members together to inhibit rotation of one of said adjustment members with respect to the other one of said adjustment members, said rod portion being rotatable in a second direction for separating said adjustment members to allow one of said adjustment members to be pivoted with respect to the other one of said adjustment members;

said fastening member comprising a handle portion, said handle portion being coupled to said rod portion of said fastening member opposite said adjustment members, said handle portion being adapted for being engaged by a hand of the user for facilitating rotation of said rod member with respect to said adjustment members;

each of said adjustment members comprising an engaging face, said engaging face of one of said adjustment members selectively abutting said engaging face of the other one of said adjustment members for frictionally coupling said adjustment members together for maintaining said rest member at the desired angle;

said adjustment assembly comprising a mounting member, said mounting member being coupled to one of said adjustment members, said mounting member being adapted for being selectively coupled to the hanger bracket of the wheel chair such that said mounting member selectively couples the associated one of said adjustment members to the hanger bracket of the wheel chair; and said adjustment assembly comprising an extension member, said extension member being coupled to one of said adjustment members, said rest member being pivotally coupled to said extension member opposite the associated one of said adjustment members, said extension member being for positioning said rest member away from said adjustment members of said adjustment assembly.

* * * * *